United States Patent [19]

Arp

[11] 4,297,819

[45] Nov. 3, 1981

[54] REINFORCED MOLDED RESIN POOL WALL

[75] Inventor: George F. Arp, Fairport, N.Y.

[73] Assignee: Heldor Associates, Inc., Morris Township, Morris County, N.J.

[21] Appl. No.: 119,102

[22] Filed: Feb. 6, 1980

[51] Int. Cl.[3] ..... E04H 3/16

[52] U.S. Cl. ..... 52/293; 52/169.8; 52/265; 52/288; 52/584; 52/586; 52/590

[58] Field of Search ..... 52/169.7, 169.8, 265, 52/288, 584, 586, 590, 293

[56] References Cited

U.S. PATENT DOCUMENTS

| | | | |
|---|---|---|---|
| Re. 29,936 | 3/1979 | Arp | 52/602 X |
| 1,991,550 | 2/1935 | Duffy | 52/293 |
| 2,200,636 | 5/1940 | Palmer | 52/293 |
| 2,368,330 | 1/1945 | Schwartz | 52/590 X |
| 3,950,907 | 4/1976 | Dahowski | 52/169.7 X |
| 4,023,217 | 5/1977 | Kessler | 52/169.7 X |
| 4,047,340 | 9/1977 | Witte et al. | 52/169.7 |
| 4,124,907 | 11/1978 | Laven | 52/169.7 |
| 4,177,614 | 12/1979 | Arp | 52/169.7 X |

FOREIGN PATENT DOCUMENTS

| | | | |
|---|---|---|---|
| 1272729 | 5/1972 | United Kingdom | 52/586 |

*Primary Examiner*—Alfred C. Perham
*Attorney, Agent, or Firm*—Stonebraker, Shepard & Stephens

[57] ABSTRACT

A pool wall is formed of resin panels 10 that are reinforced and connected end to end with inward facing walls 11 having peripheral flanges and strengthening ribs 16–19 that extend outward. End flanges 14 and 15 have longitudinal alternating projections 20 along their inner and outer edges, and the alternation of projections is reversed on opposite panel ends to form mating interlocks holding panels 10 against vertical relative movement. Projection free spaces between projections 20 form vertical channels 25 extending up end flanges 14 and 15, and holes 24 on end flanges 14 and 15 are spaced along channels 25. Horizontal channels 26 extend along the top flange 12 to join and extend between vertical channels 25. Strip-shaped lengths of reinforcing material extend along the vertical and horizontal channels, and the vertical strips lock the connected panel ends to resist transverse horizontal movement between panels 10. Holes in the reinforcing strips 30 and 31 or 35 register with holes 24 in the end flanges, and the strips are fastened together by bolts extending through the end flange holes 24 and securing panels 10 in their end-to-end formation.

21 Claims, 10 Drawing Figures

REINFORCED MOLDED RESIN POOL WALL

BACKGROUND

There have been many suggestions, including my U.S. Pat. No. Re. 29,936 and U.S. Pat. No. 4,177,614, for forming swimming pool walls of molded resin panels, preferably of a structural foam material. Structural foam panels are lightweight, do not rust, can be molded in modular units, are easy to assemble, and have other advantages over steel walls for swimming pools; but they lack the strength of steel, and they deform from their intended shape in a pool wall. If they are thickened and braced enough to have the strength of steel, they become too costly. So, in spite of many attempts with different configurations of molded resin pool wall panels, they have not yet succeeded in the marketplace.

This invention involves recognition of the problem of making satisfactorily strong swimming pool walls with molded resin panels and proposes a way of reinforcing the panels with steel or other strong material to achieve the benefits and economies of structural foam while insuring adequate strength. The invention considers molding and manufacturing requirements, assembly cost, wall construction, and the strength of the completed pool wall and achieves a configuration and arrangement that meets all the requirements and is economically competitive.

SUMMARY OF THE INVENTION

I form a pool wall of reinforced resin panels connected end to end and having inward facing walls with peripheral flanges and strengthening ribs that extend outward from the facing walls. Longitudinal projections alternate along the inner and outer edges of the end flanges of the panels with the alternation being reversed on the opposite ends of the panels to form mating interlocks at the connected panel ends resisting vertical relative movement between panels. Free spaces between the interlocked projections form vertical channels extending up the end flanges, which have holes spaced along these vertical channels. Horizontal channels are formed along top flanges to join and extend between the vertical channels. Reinforcing strips extend up the vertical channels and lock the connected panel ends against transverse horizontal movement between the panels. Reinforcing strips also extend along the horizontal channel at the top of the panel and down the opposite end to the uppermost end flange hole. Holes in the reinforcing strips register with the holes in the end flanges, and the strips are connected together by bolts through the end flanges to secure the panels end to end. Panels in the completed wall are thus reinforced along their tops and ends and are easily anchored with concrete along their bottoms to form a strong wall.

DRAWINGS

Figures 1, 2, 3, 4, 5:
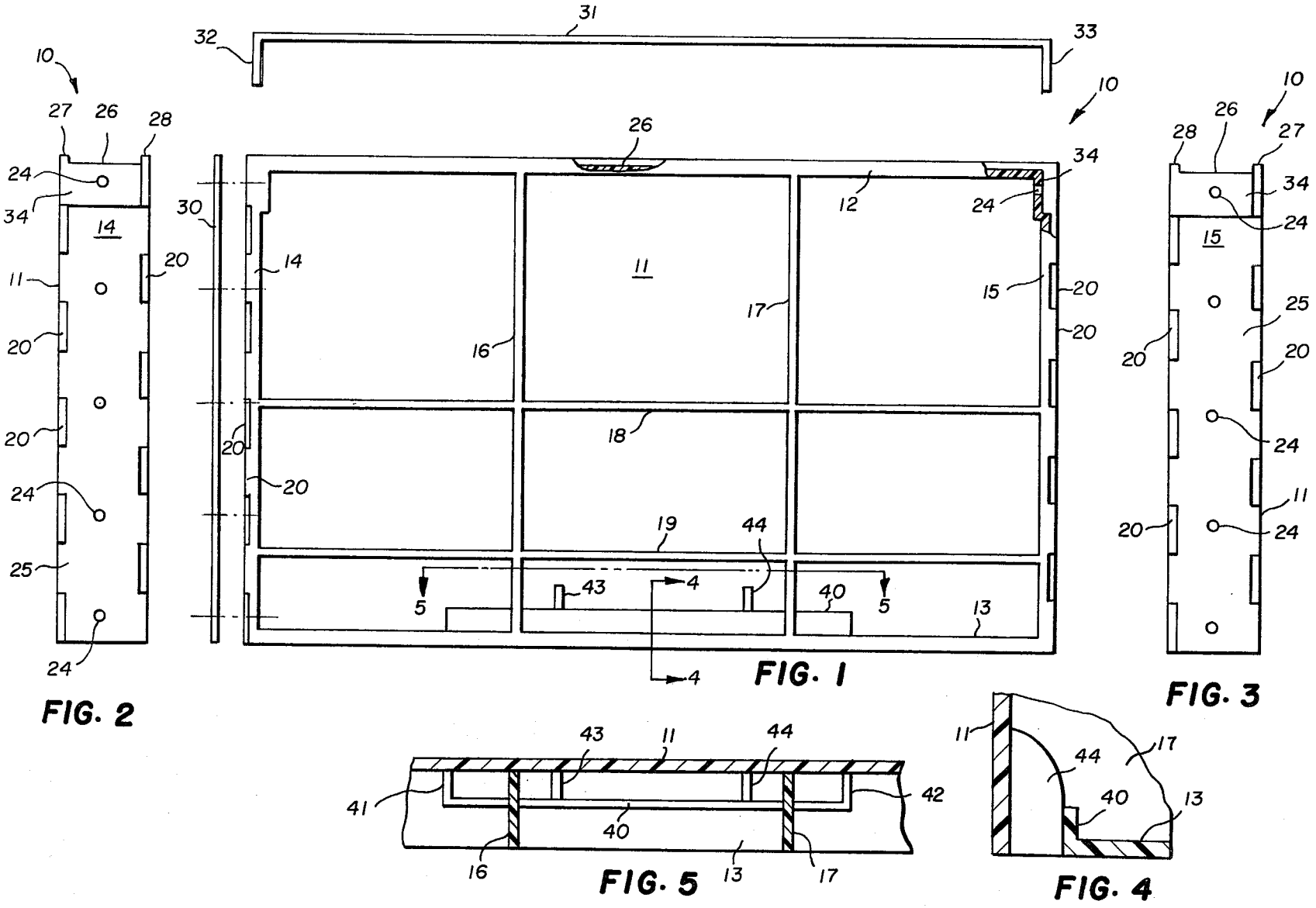
FIg. 1 is a partially cutaway, partially exploded, rear elevational view of a preferred embodiment of my reinforced pool wall panel.
FIGS. 2 and 3 are respective left and right end elevational views of the panel of FIG. 1 without reinforcing strips.
Figure 6:
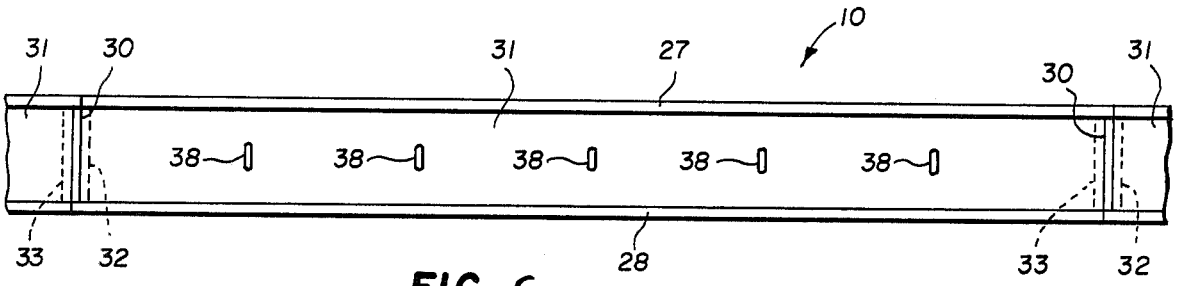
Figure 7:
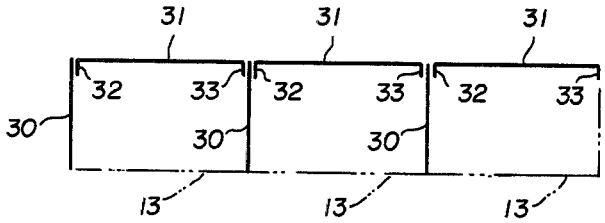
Figure 8:
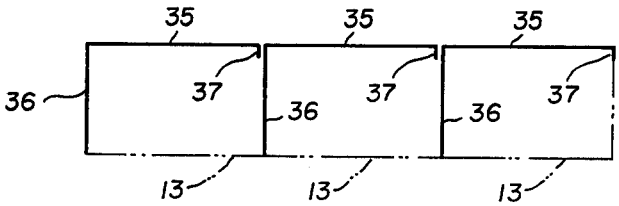
Figure 9:
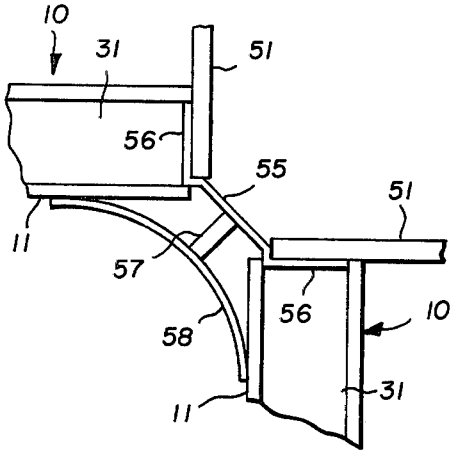
Figure 10:
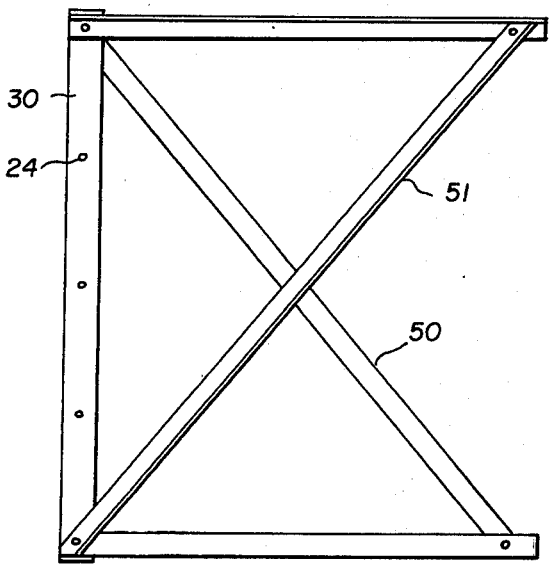

FIGS. 4 and 5 are cross-sectional views of the panel of FIG. 1 taken respectively along the lines 4—4 and 5—5 thereof;

FIG. 6 is a plan view of a section of pool wall assembled from the panels of FIG. 1;

FIGS. 7 and 8 are partially schematic, elevational views of alternative ways of arranging reinforcing strips in a pool wall formed according to the invention;

FIG. 9 is a fragmentary plan view of a preferred corner construction for my pool wall; and FIG. 10 is a partially schematic, elevational view showing how braces can be secured to reinforcing strips within a pool wall according to my invention.

DETAILED DESCRIPTION

Panels 10 molded of a resin material such as structural foam provide rectangular, modular units connected end to end to form a pool wall. Reinforcing that is described below cooperates with panels 10 to make the wall strong and structurally secure, while preserving the many advantages of molded resin. Panels 10 can be formed of many different resins that can contain fillers or reinforcing material, and panels can be formed in different lengths. I prefer panels about 42 inches tall, formed in a standard length of four feet with auxiliary lengths of two feet and three feet to make different dimensions available.

Panels 10 are shaped for moldability; manufacturing convenience and economy; structural strength and stability in a pool wall; compatibility with a reinforcing system; ease of assembly; and accommodation to braces, corner assemblies, and other structural necessities in swimming pool walls. This forces a complex set of requirements on panels 10, which have emerged as a preferred solution.

Panel 10 has a generally plane facing wall 11 facing inward to support a swimming pool liner; and extending outward from facing wall 11 are peripheral flanges and ribs that include a top flange 12, a bottom flange 13, end flanges 14 and 15, vertical ribs 16 and 17, and horizontal ribs 18 and 19. Panel 10 stands on bottom flange 13 so that top flange 12 is above the water line and can support coping or deck elements. End flanges 14 and 15 are interconnected between panels 10 along the length of a pool wall, and ribs 16–19 strengthen the panel and can have different shapes and locations. Horizontal ribs 18 and 19 are located toward the middle and lower half of panel 10 for distributing their strengthening effect along the lower half of the panel where stress from water and earth pressure is greatest.

End flanges 14 and 15 of panel 10 have alternating projections 20 along their inner edge adjacent facing wall 11 and their outer edge opposite facing wall 11. The illustrated alternation of projections 20 allows them to be formed in a mold that parts in a direction perpendicular to the plane of facing wall 11, and the alternation of projections 20 is reversed between flanges 14 and 15 as illustrated to form a mating interlock between the ends of panels. Projections 20 on end flange 15 fit into the spaces between projections 20 on end flange 14 to guide adjacent panels into a perfect fit and prevent any vertical relative movement between them.

The projection free spaces along the centers of end flanges 14 and 15 between projections 20 form vertical channels 25 extending up end flanges 14 and 15. Holes 24 are preferably molded along the center of channel 25 and spaced from top to bottom of end flanges 14 and 15. Reinforcing strips fill channels 25 as explained more fully below to lock adjacent panels against transverse horizontal movement.

Another channel 26, preferably the same width and depth as channel 25, extends along top flange 12 to join and extend between vertical channels 25. The respective inner and outer edges 27 and 28 of top channel 26 can be continuous as illustrated or formed of alternating projections like channels 25 on the end flanges.

The reinforcing for panel 10 is preferably strip-shaped lengths of steel or other strong material dimensioned for a snug fit in channels 25 and 26. One preferred configuration for the reinforcing is a vertical strip 30 extending up one of the channels 25 on one end of panel 10 interconnected with a horizontal strip 31 extending along channel 26. Strips 31 has bent down ends 32 and 33 that fit into shallow recesses formed at the upper ends of channels 25. Bent down ends 32 and 33 also have holes that register with uppermost holes 24 in end flanges 14 and 15, and vertical strips 30 have holes registering with all the holes 24 in the end flanges. Strip 30 can extend up channel 25 on either end flange 14 or 15 where they are joined with bent down end 32 or 33 of strip 31 at upper bolt hole 24. Then as flanges are positioned end to end and bolted together with bolts extending through holes 24, reinforcing strips 30 and 31 are secured together to surround three sides of each panel in the configuration schematically shown in FIG. 7.

Horizontal top strips 31 bolted together at their connections with vertical strips 30 form a straight reinforcing line along the top of the pool wall to maintain the pool wall in a straight line. Vertical strips 30, fitting between projections 20, form a positive horizontal interlock between adjacent panel 10 and also stiffen and strengthen the vertical junctions between panels. Strips 30 and 31 extend around three sides of each panel and distribute stress over wide regions of the panels to make the combination of panels and reinforcing strips very strong.

A generally known concrete collar poured over bottom flange 13 along the outside of a pool wall formed of panels 10 forms a secure and fixed anchorage strengthening the bottoms of panels 10. Additional steel reinforcing strips could also be positioned along bottom flanges 13 if desired, but a concrete collar is easier and better. The concrete cooperates with reinforcing strips 30 and 31 to stiffen and strengthen all four sides of each panel 10 so that its capacity to deform throughout the extent of facing wall 11 is limited to acceptably small amounts. Ribs 16-19 also cooperate to strengthen facing wall 11 so that panels 10 remain adequately flat and non-deformable while withstanding the stresses that occur in a swimming pool wall.

Instead of two reinforcing strips 30 and 31, a single reinforcing strip 35 can extend across the panel top and have a vertical leg 36 extending down a vertical channel 25 to reinforce the top and one end of each panel. A bent down end 37 extends down to an upper bolt hole 24 so that reinforcing strips 35 are bolted together in the configuration schematically shown in FIG. 8 when the wall is assembled. The result is practically the same as the arrangement of FIG. 7, because the top and one vertical end of each panel bear reinforcing strips so that the interlocked panels are reinforced by strips along three sides and braced along the bottom by a concrete collar for complete reinforcement along the entire pool wall.

The reinforcing system for panels 10 also cooperates with generally known bracing systems for a pool wall as schematically shown in FIG. 10. Bolts through top and bottom holes 24 joining end flanges 14 and 15 can also anchor braces 50 and 51 to the pool wall. This ties braces 50 and 51 to the reinforcing strips so that stress from the bracing is widely distributed over panels 10. Also, bolts joining panels and the reinforcing system do not merely secure resin flanges together, but pass through reinforcing strips and the ends of braces 50 and 51 so that stress is not concentrated in small regions of resin material.

Reinforcing strips 30 and 31 or 35 are preferably lightly attached to each panel 10 after molding and are shipped with panels 10 so that the reinforcing is properly positioned relative to the panels for assembling a pool wall. Workers then need only position panels 10 end to end and bolt them together through holes 24 together with whatever braces 50 and 51 are desired. Screws or other fasteners can hold the reinforcing strips on panels 10 during shipment, and assembly bolts anchor them permanently and securely in place in the pool wall during construction.

The reinforcing strip 31 or 35 extending along top channel 26 preferably has slots 38 spaced along its length to receive fasteners for a coping element. This can include an extruded bullnose or coping member fastened to the tops of panels 10 and to reinforcing strips 31 or 35 by self-tapping screws driven into slots 38.

To facilitate the interlock with a concrete collar poured along base flange 13, panels 10 have a raised ridge 40 extending upward from bottom flange 13 and spaced outward from facing wall 11. Walls 41 and 42 join the ends of ridge 40 to facing wall 11, and intermediate strengthening ribs 43 and 44 join central regions of ridge 40 to facing wall 11. In addition, ridge 40 passes through and joins to vertical strengthening ribs 16 and 17 so that it is strong along its full longitudinal length covering a substantial distance of bottom flange 13.

When a concrete collar is poured onto bottom flange 13 to spill against facing wall 11, it flows over ridge 40 and into the space between ridge 40 and facing wall 11 to form a secure interlock with the bottom of panel 10. Ribs 16 and 17, walls 41 and 42, and ribs 43 and 44 give lateral strength to ridge 40 so that the bottom of panel 10 cannot move relative to the concrete collar engaging both sides of interlocking ridge 40.

A preferred corner construction shown in FIG. 9 includes a corner brace 55 having vertical strips 56 bolted into channels 25 or against vertical reinforcing strips 30 or 36 at the ends of panels 10. Standoff projections 57 extend inward from brace 55 at the pool corners to support a curved element 58 that forms a corner radius between panels 10.

Many alternatives are possible in applying my invention to specific pool walls. For example, instead of flat reinforcing strips of steel or stainless steel, reinforcing strips can be channel-shaped or have H, I, or Z shaped sections to achieve greater strength with less material. Channels 25 and 26 on panels 10 can be changed in depth and width to accommodate different reinforcing strips and materials. Different forms of bracing can be bolted into the reinforcing system when panels are joined together in a pool wall, and many alternatives for corner braces and coping elements are also possible. Panels 10 can be molded with marking lines for cutting out openings for skimmers, drains, lights, and other pool accessories; panels can be made in different shapes for curved pool walls, and can have different dimensions to cooperate with decks, ladders, steps, and other pool constructions. Also, a ridge to interlock with a concrete collar around the base of the pool wall can be structured in other ways. Workers familiar with the art of constructing swimming pool walls will recognize other alternatives once they understand the basic elements of the invention.

I claim:

1. A pool wall formed of molded resin panels connected end to end, said panels having inward facing walls with peripheral flanges and strengthening ribs extending outward from said facing walls, said pool wall comprising:

a. longitudinal projections alternating along inner and outer edges of end flanges of said panels;

b. the alternation of said projections being reversed on opposite ends of said panels so that said projections at connected ends of said panels form mating interlocks against vertical relative movement from panel to panel along said wall;

c. projection free spaces between said interlocked projections forming vertical channels extending up said end flanges of said panels;

d. said end flanges having holes spaced along said vertical channels;

e. horizontal channels formed along top flanges of said panels to join and extend between said vertical channels;

f. reinforcing strips extending up said vertical channels between said interlocked projections to lock said connected ends of said panels against transverse horizontal movement relative to each other;

g. said reinforcing strips also extending along said horizontal channels;

h. said reinforcing strips having holes registered with said holes in said end flanges; and i. bolts extending through said end flanges and said reinforcing strips to connect said reinforcing strips together and secure said panels end to end.

2. The pool wall of claim 1 wherein said bolts fasten braces to said reinforcing strips and said end flanges.

3. The pool wall of claim 1 wherein said bottom flanges of said panels have a raised ridge spaced from said facing wall to interlock with a concrete collar around the bottom of said wall.

4. The pool wall of claim 1 wherein said strengthening ribs include horizontal ribs spaced toward the bottom of said panels.

5. The pool wall of claim 1 wherein said reinforcing strips are formed as vertical strips extending up one end of each panel and separate horizontal strips extending along the top of each panel and having bent down ends with holes for connection to said vertical strips by said bolts.

6. The pool wall of claim 1 wherein said reinforcing strips are formed to extend up one end and along the top of each panel to a bent down end having a hole for connection to an adjoining reinforcing strip by one of said bolts.

7. The pool wall of claim 1 wherein said reinforcing strips along said tops of said panels have slots for receiving fasteners for coping elements.

8. The pool wall of claim 1 wherein said projections and said reinforcing strips are dimensioned so said reinforcing strips substantially fill said vertical channels.

9. The pool wall of claim 8 wherein said bolts fasten braces to said reinforcing strips and said end flanges.

10. The pool wall of claim 9 wherein said bottom flanges of said panels have a raised ridge spaced from said facing wall to interlock with a concrete collar around the bottom of said wall.

11. The pool wall of claim 10 wherein said strengthening ribs include horizontal ribs spaced toward the bottom of said panels.

12. A molded resin panel reinforced for a pool wall, said panel having an inward facing wall with peripheral flanges and strengthening ribs extending outward from said facing walls, and said panels comprising:

a. longitudinal projections alternating along inner and outer edges of end flanges of said panel;

b. the alternation of said projections being reversed on opposite ends of said panel so that said projections form a mating interlock against vertical relative movement when a plurality of said panels are positioned end to end along a pool wall;

c. projection free spaces between said alternating projections forming vertical channels extending up each end flange of said panel;

d. said end flanges having holes spaced along said vertical channels;

e. a horizontal channel formed along the top flange of said panel to join and extend between said vertical channels;

f. strip-shaped reinforcing formed to extend up said vertical channel at one end of said panel, along said horizontal channel at the top of said panel and down the opposite end of said panel to the uppermost end flange hole; and g. said reinforcing having holes registered with said holes in said end flanges so that said reinforcing can be bolted together from panel to panel by bolts that also pass through said end flanges.

13. The panel of claim 12 wherein said bottom flange has a raised ridge spaced from said facing wall to interlock with a concrete collar formed at the bottom of said panel.

14. The panel of claim 12 wherein said strengthening ribs include horizontal ribs spaced toward the bottom of said panel.

15. The panel of claim 12 wherein said reinforcing is formed as a vertical strip extending up one end of said panel and a horizontal strip extending along the top of said panel and having bent down ends with holes registered with an uppermost one of said end flange holes for connection with said vertical strips when a plurality of said panels are positioned end to end along a pool wall.

16. The panel of claim 12 wherein said reinforcing is formed as a single strip extending up one end and along the top of said panel to a bent down end with a hole registered with an uppermost one of said end flange holes.

17. The panel of claim 12 wherein said reinforcing along said top of said panel has slots for receiving fasteners for coping elements.

18. The panel of claim 12 wherein said channels and said reinforcing are dimensioned so said reinforcing substantially fills said channels.

19. The panel of claim 18 wherein said bottom flange has a raised ridge spaced from said facing wall to interlock with a concrete collar formed at the bottom of said panel.

20. The panel of claim 19 wherein said strengthening ribs include horizontal ribs spaced toward the bottom of said panel.

21. The panel of claim 20 wherein said reinforcing along said top of said panel has slots for receiving fasteners for coping elements.

* * * * *